US008413409B2

(12) United States Patent
Nighy et al.

(10) Patent No.: US 8,413,409 B2
(45) Date of Patent: Apr. 9, 2013

(54) POUCH HANDLING MECHANISM

(75) Inventors: Richard John Nighy, Stratford upon Avon (GB); Scott Nicholson, Rivers Falls, WI (US)

(73) Assignee: IMI Cornelius Inc., Glendale Heights, IL (US)

( * ) Notice: Subject to any disclaimer, the term of this patent is extended or adjusted under 35 U.S.C. 154(b) by 0 days.

(21) Appl. No.: 12/451,134

(22) PCT Filed: Apr. 28, 2008

(86) PCT No.: PCT/GB2008/001488

§ 371 (c)(1),
(2), (4) Date: Mar. 8, 2010

(87) PCT Pub. No.: WO2008/132476

PCT Pub. Date: Nov. 6, 2008

(65) Prior Publication Data

US 2010/0186348 A1 Jul. 29, 2010

(30) Foreign Application Priority Data

Apr. 28, 2007 (GB) ..... 0708272.0

(51) Int. Cl.
*B65B 5/00* (2006.01)

(52) U.S. Cl.
USPC ..... 53/281; 53/282

(58) Field of Classification Search ..... 53/281, 53/282, 284.2, 390, 173, 251
See application file for complete search history.

(56) References Cited

U.S. PATENT DOCUMENTS

| | | | | |
|---|---|---|---|---|
| 3,596,430 | A | 8/1971 | Parish | |
| 3,868,891 | A * | 3/1975 | Parish | 493/194 |
| 4,120,134 | A | 10/1978 | Scholle | |
| 4,250,691 | A * | 2/1981 | Marshall | 53/505 |
| 4,297,929 | A * | 11/1981 | Schieser et al. | 83/110 |
| 4,415,085 | A * | 11/1983 | Clarke et al. | 206/526 |
| 4,510,737 | A | 4/1985 | Ellert | |
| 4,620,411 | A | 11/1986 | Schieser et al. | |
| 5,581,975 | A * | 12/1996 | Trebbi et al. | 53/284.6 |
| 7,010,900 | B2 * | 3/2006 | Grossmann et al. | 53/167 |

* cited by examiner

*Primary Examiner* — Sameh H. Tawfik
(74) *Attorney, Agent, or Firm* — Gifford, Krass, Sprinkle, Anderson & Citkowski, P.C.

(57) ABSTRACT

Apparatus for handling and filling flexible pouches in which a feeder mechanism 300 delivers a chain of interlinked flexible pouches 200 to a selector mechanism 600 comprising a linear actuator 602 and selector head 604 operable to detach the leading pouch 200 from the chain of pouches and move the selected pouch 200 to a station for removing a cap from the pouch 200, filling the pouch 200 with liquid, re-attaching the cap and releasing the pouch for dispense.

18 Claims, 12 Drawing Sheets

POUCH HANDLING MECHANISM

This invention relates to pouch handling mechanisms, and more particularly to mechanisms for handling and filling flexible pouches.

BACKGROUND OF THE INVENTION

It is known in the art that flowable products, for example beverages, shampoos, cosmetics etc can be conveniently packaged in flexible pouches. Usually these products are manufactured in large quantities of similar product and on a production line known as a form fill seal line. In this process the pouch is formed in a first part of the machine, filled at the next and then sealed, thus achieving a highly automated system. This system is very effective and is well suited to producing high volume runs of products. However, it is less effective when greater flexibility is needed, i.e. when more runs of lower volume are required, as the changeover time of the system from filling one product to another is very high. Thus a more flexible solution is needed whereby the pouches can be manufactured and sealed in one location and then filled in smaller batches at a second location. Such a system is provided in the CMF series of filling machines manufactured by Hensen Packaging Concept GmbH. This system goes some way to providing a solution by providing a machine that fills ready formed bags. This design loads empty bags with spouts already inserted onto a holding rail by way a linear array. Holding rails are loaded onto the machine and are vibrated to cause the pouches to feed along the holding rail towards the point of use. One major problem associated with these machines is that they do not have a high degree of automation as it is a relatively labour and time intensive operation to load the bags on the rails and to load the rails onto the machine in such a way that the machine can easily select the pouch to be filled.

SUMMARY OF THE INVENTION

It is an object of the present invention to provide an improved system for handling and filling flexible pouches According to the present invention there is provided a pouch handling apparatus for selecting a flexible pouch from a chain of flexible pouches, and filling the flexible pouch, the apparatus comprising:

- a presentation means for presenting at least one chain of flexible pouches into a feeder mechanism through which said chain of pouches passes, said flexible pouches being interlinked via their spouts,
- a means operable to engage with the spout of the end pouch of said interlinked chain, and to convey said end pouch from the feeder mechanism towards a filling position,
- a means to pull, via the interlinked spouts, the remainder of the pouches towards the feeder mechanism;
- a means of separating a flexible pouch from the end of the chain of interlinked pouches;
- a means of filling a flexible pouch via the spout thereof in the filling position;
- a means of closing the spout; and
- a means of releasing the pouch from the pouch handling apparatus.

In one preferred arrangement the means operable to engage with the spout comprises the feeder mechanism.

In a preferred arrangement the pouch is filled at the filling position prior to being detached from the chain. In an alternative arrangement the pouch is detached from the chain prior to being filled at the filling position.

Preferably the said means operable to engage with the spout and said means of separating a flexible pouch from the end of the chain comprise one and the same means.

Preferably the spouts of the chain of pouches are provided with caps to maintain them internally clean, and the apparatus further comprises a means for removing the cap prior to filling.

In a preferred arrangement the cap is removed at the filling position, In an alternative preferred arrangement the cap is removed at a cap removal point remote from the filling position.

Preferably the means of closing the spout comprises the step of replacing the cap after the pouch has been filled.

Preferably the feeder mechanism comprises: a sprung loaded ratchet arm movable in a first direction, along the chain of pouches, in which direction of movement the ratchet arm will pivot away from the pouches thereby passing by the chain of interlinked pouches without engaging them, and movable in a second opposite direction in which the ratchet arm engages with the chain of interlinked pouches and moves them therewith into the feeder mechanism.

In one preferred arrangement the ratchet arm is arranged for linear movement. In an alternative arrangement the ratchet arm arranged for rotary movement.

Preferably the feeder mechanism further comprises a sprung retainer arm in a fixed position whereby when the pouches are moved into the feeder mechanism the retainer arm pivots to allow the chain of spouts to pass and whereby movement of the pouches in the opposite direction is prevented by engagement of the retainer arm with the chain of spouts.

Preferably, when said means operable to engage with the spout and said means of separating a flexible pouch from the end of the chain comprise one and the same means, said one and the same means comprises a linearly movable selector means arranged for movement substantially perpendicular to the direction of movement of the chain of interlinked pouches and wherein the perpendicular movement of the selector means detaches the selected pouch from the chain.

Preferably the selector means comprises a ridge, for location in a groove of the spout, and a pin, extendable through a cavity in the spout.

Preferably the pouch handling mechanism comprises: a plurality of presentation means, each presentation means having an associated feeder mechanism; means of filling a flexible pouch; means of closing the spout; means of separating a flexible pouch from the end of the chain of interlinked pouches; and a means of releasing the pouch from the pouch handling apparatus.

Preferably the pouch handling mechanism further comprises a combined capping and filling mechanism for removing a cap from a pouch, filling the pouch with liquid and re-attaching a cap to the pouch to close the spout, said mechanism movable in a horizontal and a vertical direction to present either a capper or a filling nozzle to the spout of a flexible pouch. Preferably the combined capping and filling mechanism further comprises a filling head arranged to receive and retain an array of nozzles from a plurality of liquid supplies and the filling head is indexable to present a selected one of said nozzles to the spout to fill the pouch therethrough. Preferably the pouch handling mechanism further comprises a refrigeration cowling surrounding the filling head to enable refrigerated air to circulate around said filling head to maintain it in a refrigerated condition.

BRIEF DESCRIPTION OF THE DRAWING

Embodiments of the present invention will now be described, by way of example only, in relation to the drawings in which.

DESCRIPTION OF THE PREFERRED EMBODIMENTS

Figure 1:
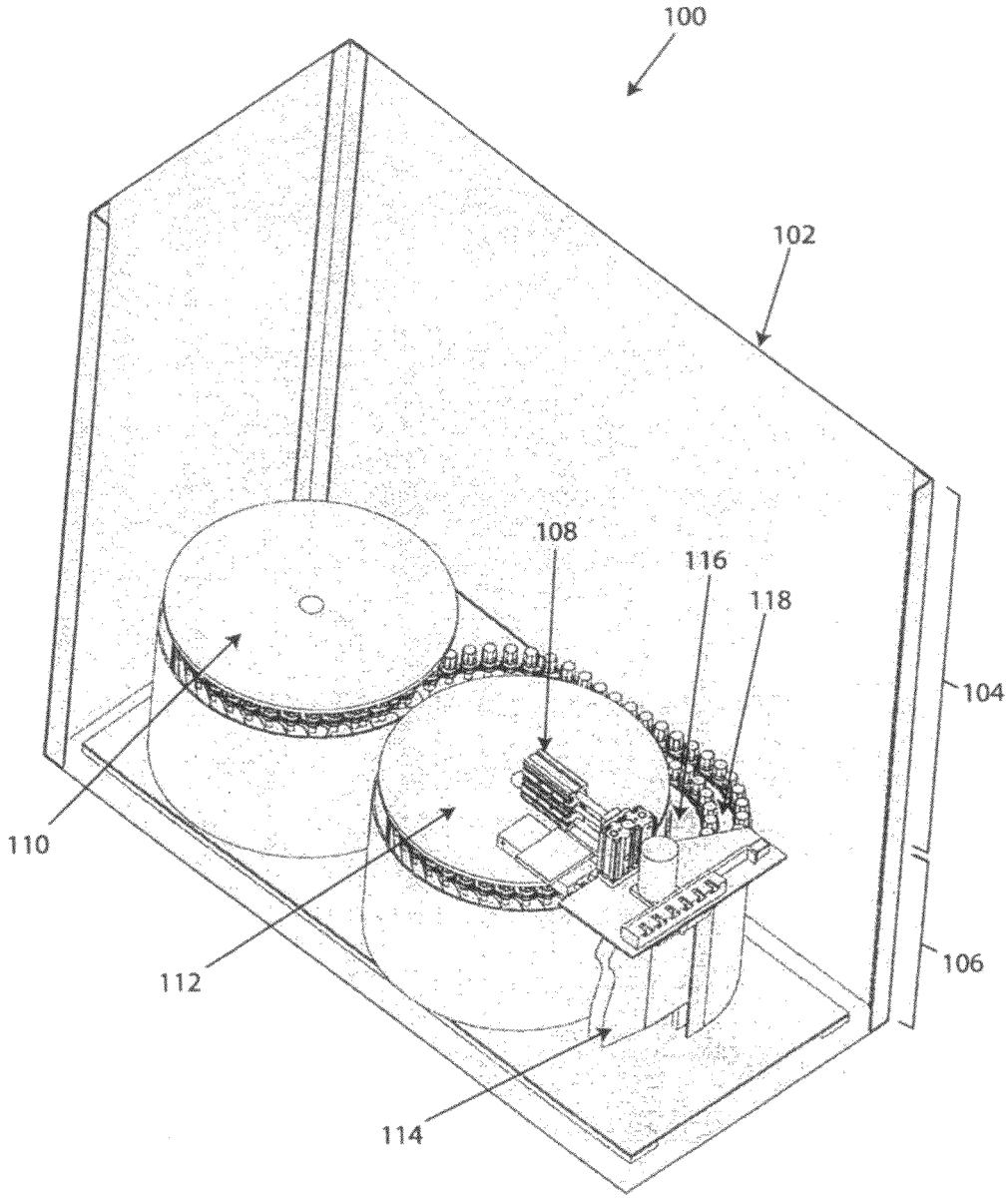
FIG. 1 is a perspective image of the pouch handling apparatus according to the invention.
Figure 2:
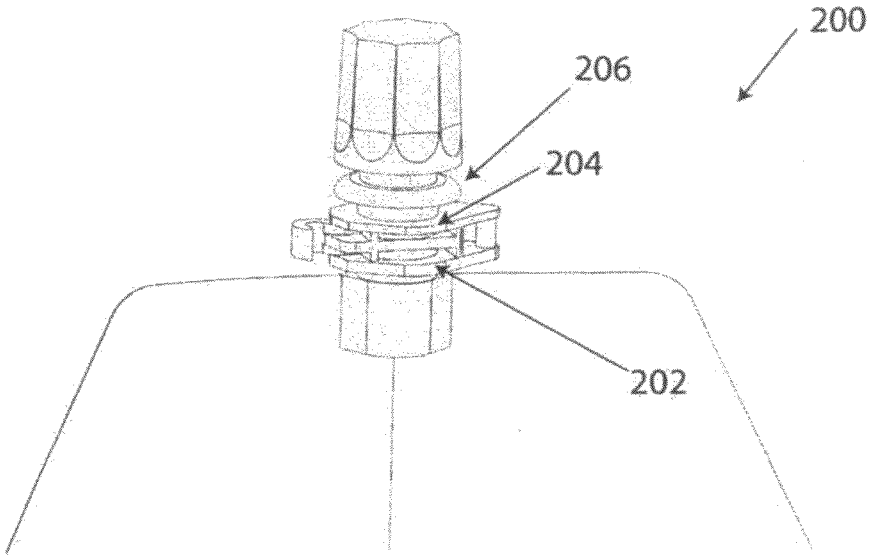
FIG. 2 shows the spout of a flexible pouch for use with the invention.

Referring to FIG. 1 a pouch handling mechanism 100 is shown comprising a cabinet 102 having an upper area 104 for containing fluid reservoirs and pumping means (omitted for clarity) and a lower area 106 containing the pouch handling mechanism 108, two bandoliers 110, 112 each containing an interlinked chain of flexible pouches 114 and presentation means 116, 118 comprising guides for the chains of pouches 114 so as to present the pouches ready for feeding into, and filling in, the pouch handling mechanism.

The pouch handling mechanism will be described in more detail in relation to FIGS. 2 to 9.

Figure 3:
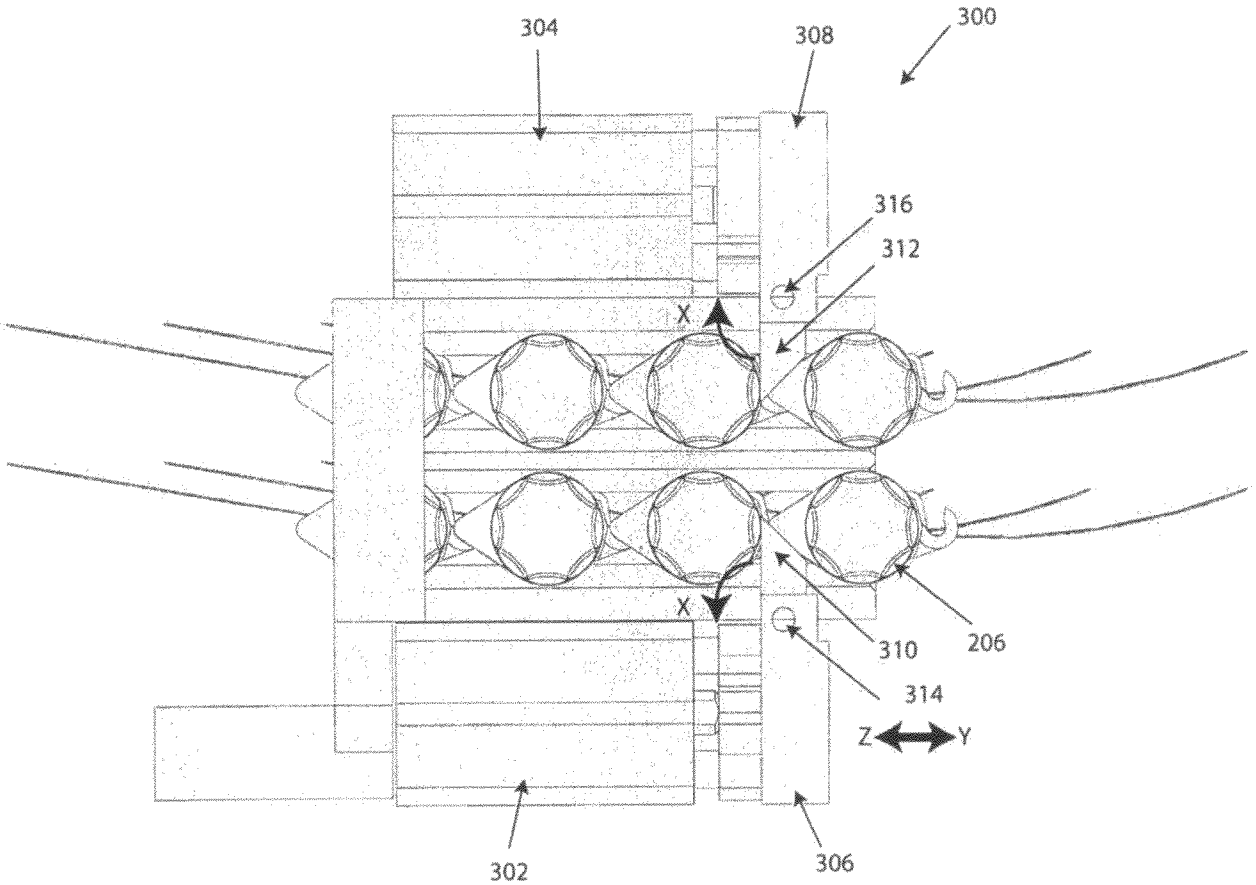
FIG. 3 is a top view of a feeder mechanism of the invention having pouches therein.
Figure 4:
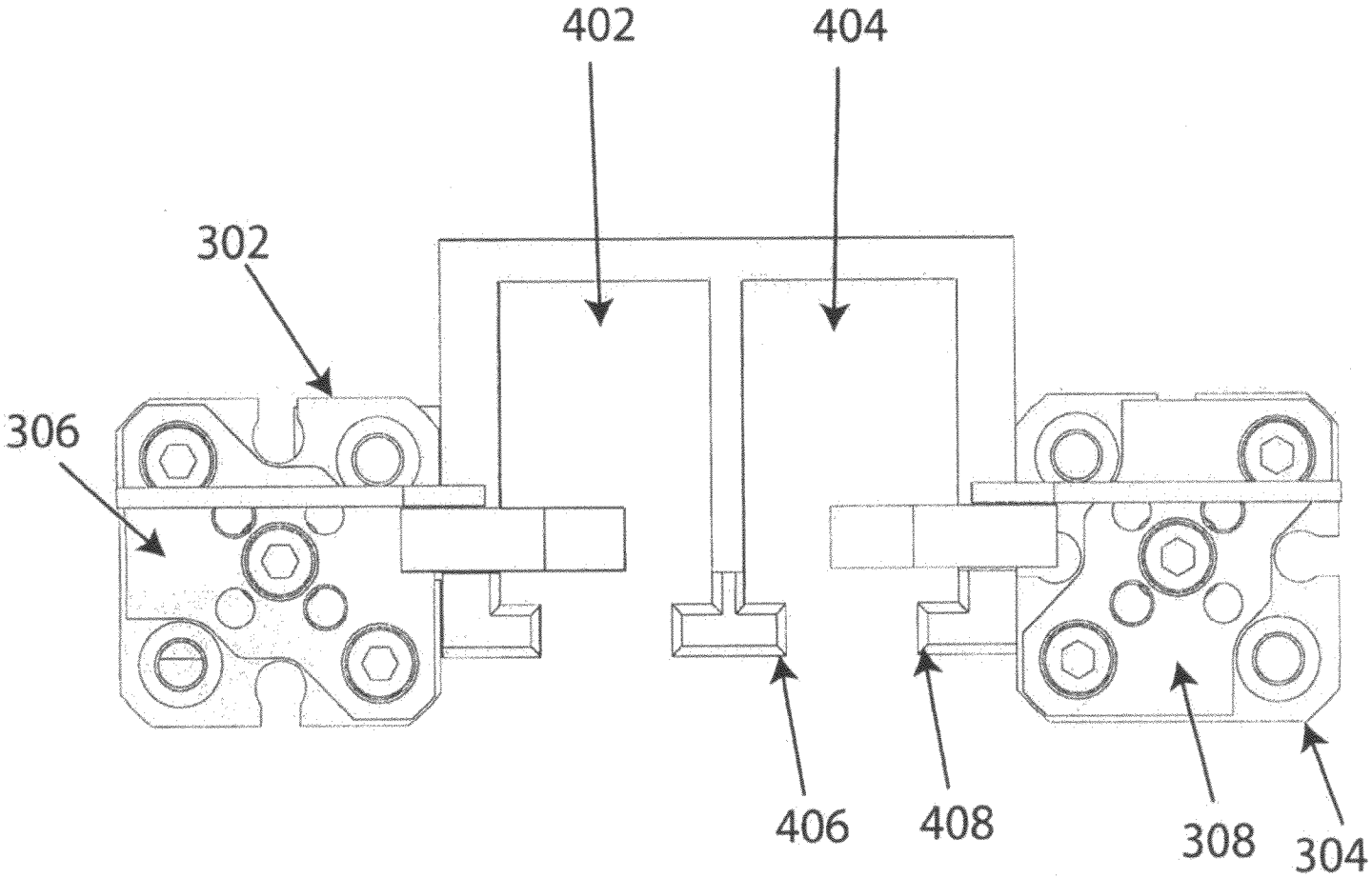
FIG. 4 is a side view of a feeder mechanism of the invention.
Figure 5:
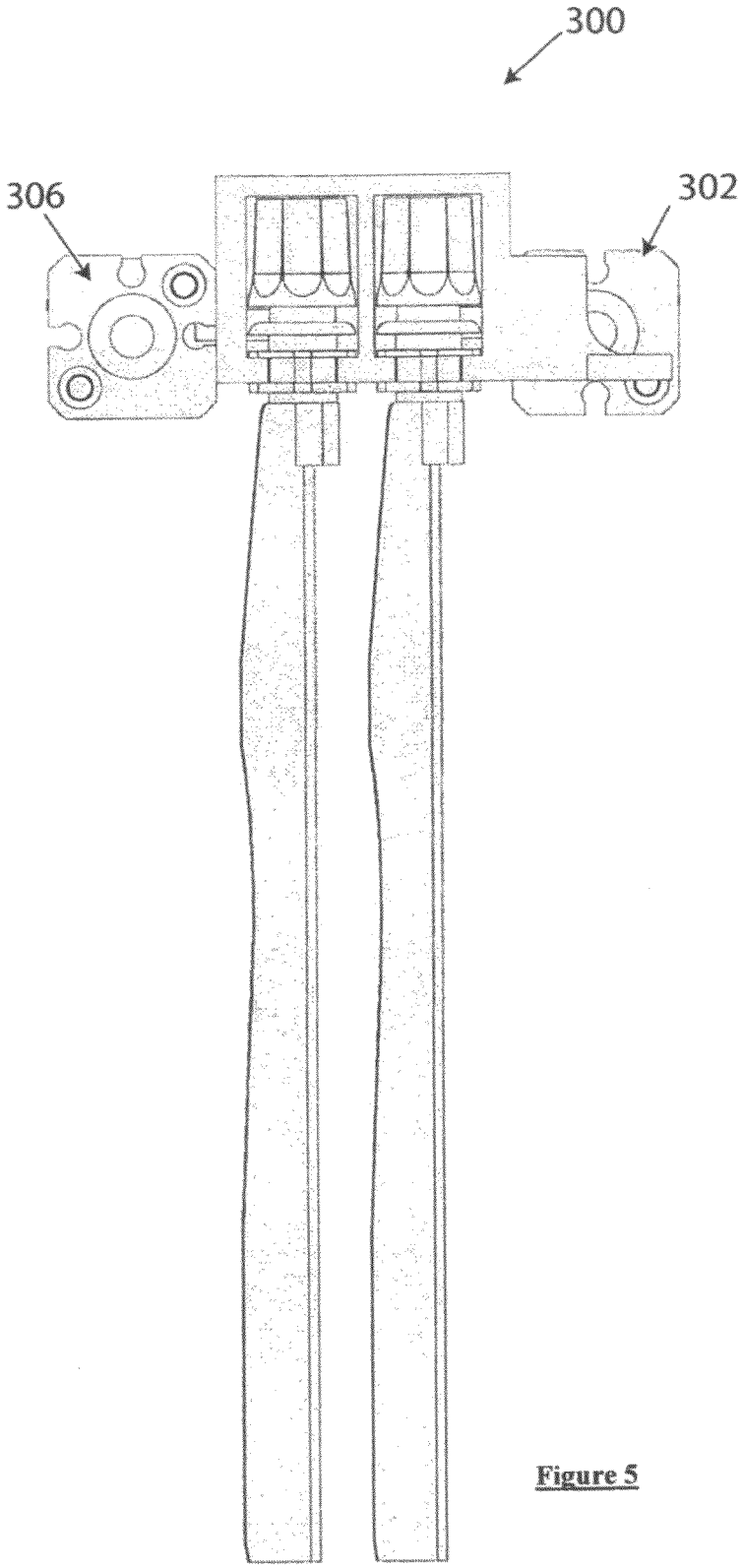
FIG. 5 is a side view of a feeder mechanism of the invention having pouches therein.

Referring to FIGS. 2 to 5 the presentation means 116, 118 (shown only in FIG. 1) presents two chains of interlinked pouches 200 in parallel into a feeder mechanism 300 having two parallel channels 402, 404. Each channel 402, 404 has a pair of lips 406, 408 running along it, orientated such that as the pouches 200 pass into the feeder mechanism 300 two flanges 202, 204 attached to each spout 206 of a pouch 200 pass either side of the lips 406, 408 thereby locating the chain of pouches in each channel 402, 404. Parallel to each channel 402, 404 is an actuator 302, 304 having a linearly movable end 306, 308 arranged for movement as indicated by arrows Y, Z parallel to the channels 402, 404. Attached to each linearly movable end 306, 308 is a pivotally mounted ratchet arm 310, 312 pivotal about pivot point 314, 316 from an end position (shown), in which it is substantially perpendicular the channels 402, 404, in the direction X towards a position in which it is substantially horizontal the channels 402, 404. In use an actuator 302, 304 extends the linearly movable end 306, 308 in the direction Y as depicted in FIG. 3. As it does so the ratchet arm 310, 312 pivots in direction X allowing it to pass by the spout 206 of the bag 200 in the direction in which it is travelling without engaging therewith. Once past the spout 206, the ratchet arm 310, 312 is sprung by a spring means (not shown) back to its end position substantially perpendicular the channels 402, 404 and in a position as depicted in FIG. 3 wherein the ratchet arm 310, 312 extends at least partially between two adjacent spouts. Subsequent actuation of the actuator, 302, 304 moves the linearly movable end 306, 308, and hence the ratchet arm attached thereto, in direction Z such that the ratchet arm 310, 312 engages with a spout 206 of a flexible pouch 200 of the chain, moving the chain therewith to feed it through the feeder mechanism 300. As the pouches 200 are interlinked by their spouts 206 movement will translate down the chain via the interlinked spouts 206 to pull the chain of pouches 200 towards the feeder mechanism 300.

Figure 6A:
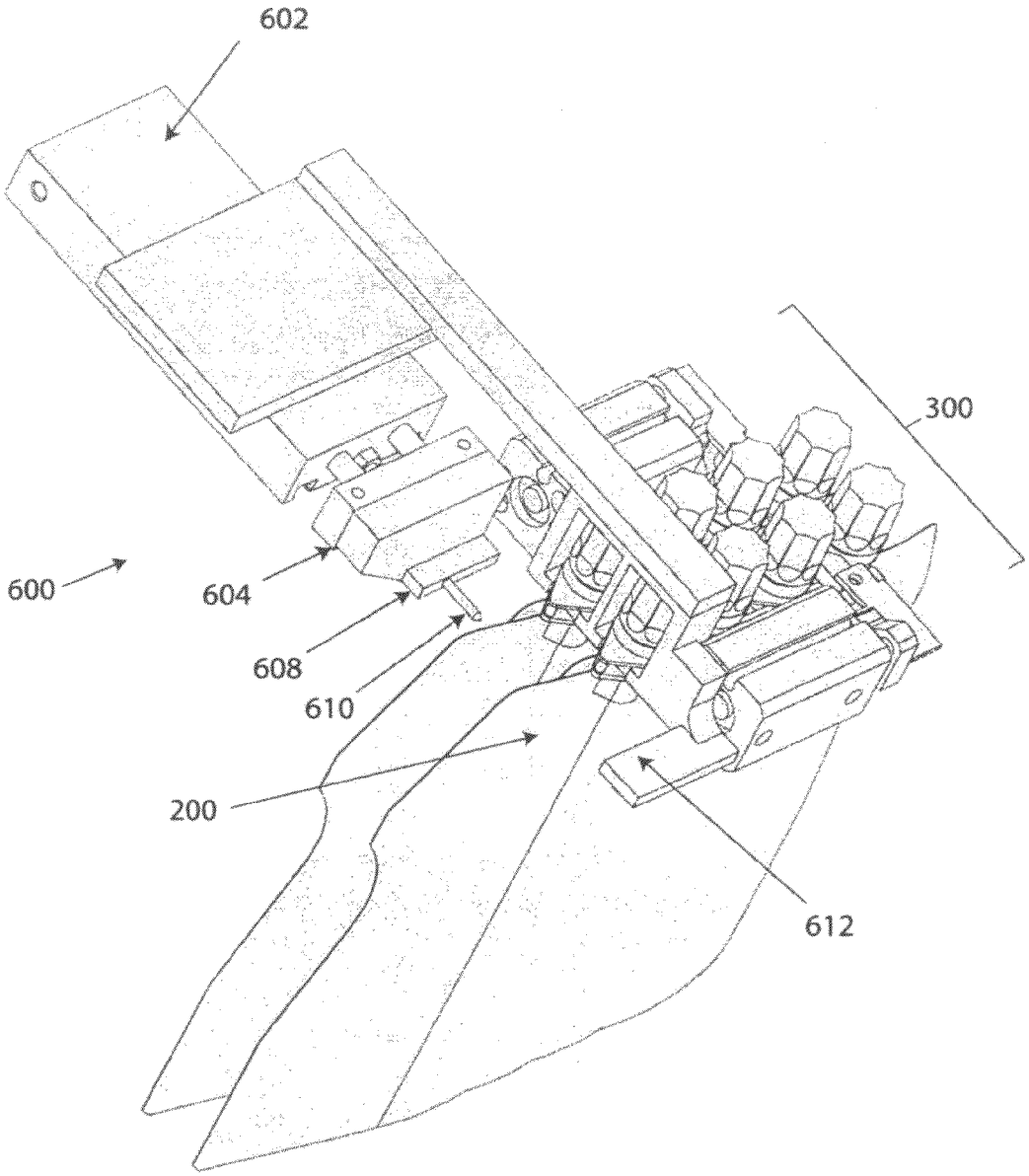
FIGS. 6*a* to 6*d* are perspective views of the action of the separator mechanism separating a pouch form the chain of pouches.
Figure 6B:
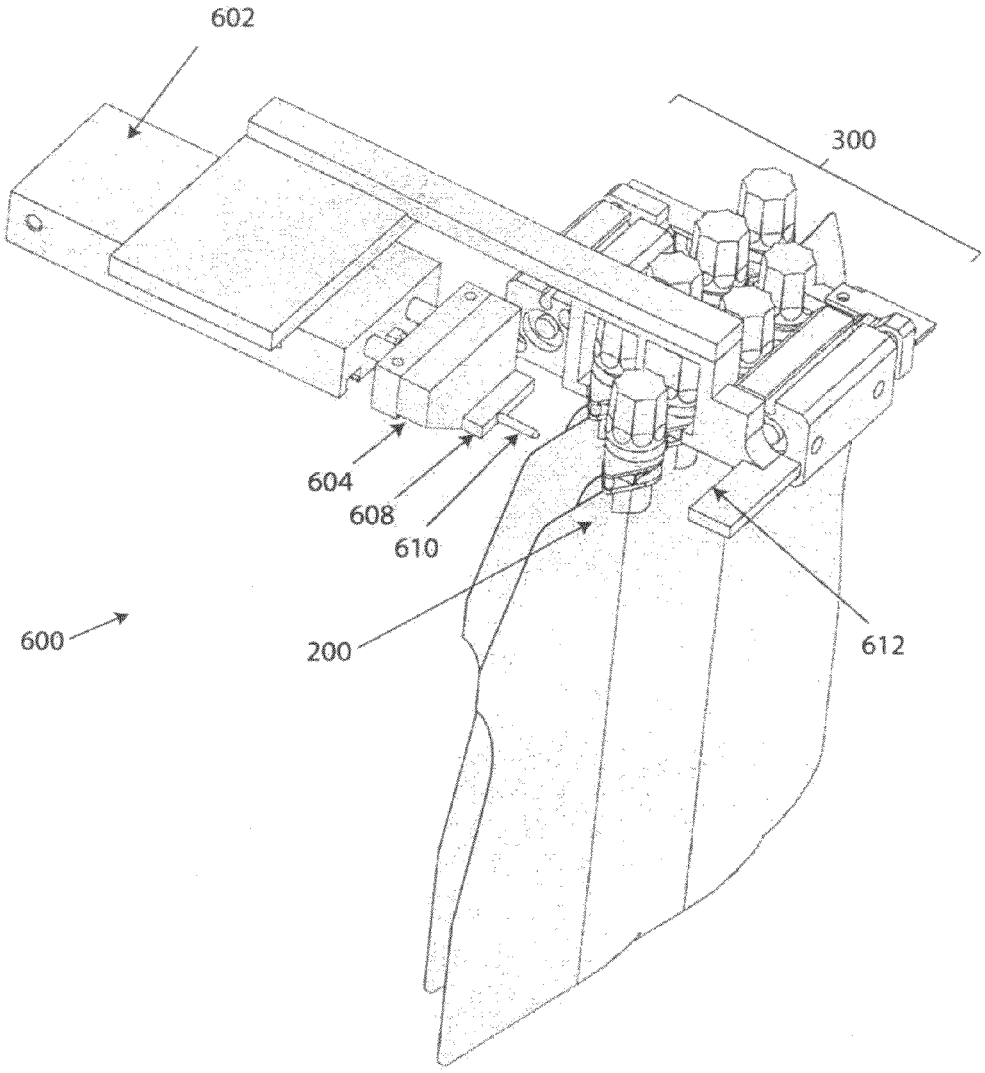
Figure 6C:
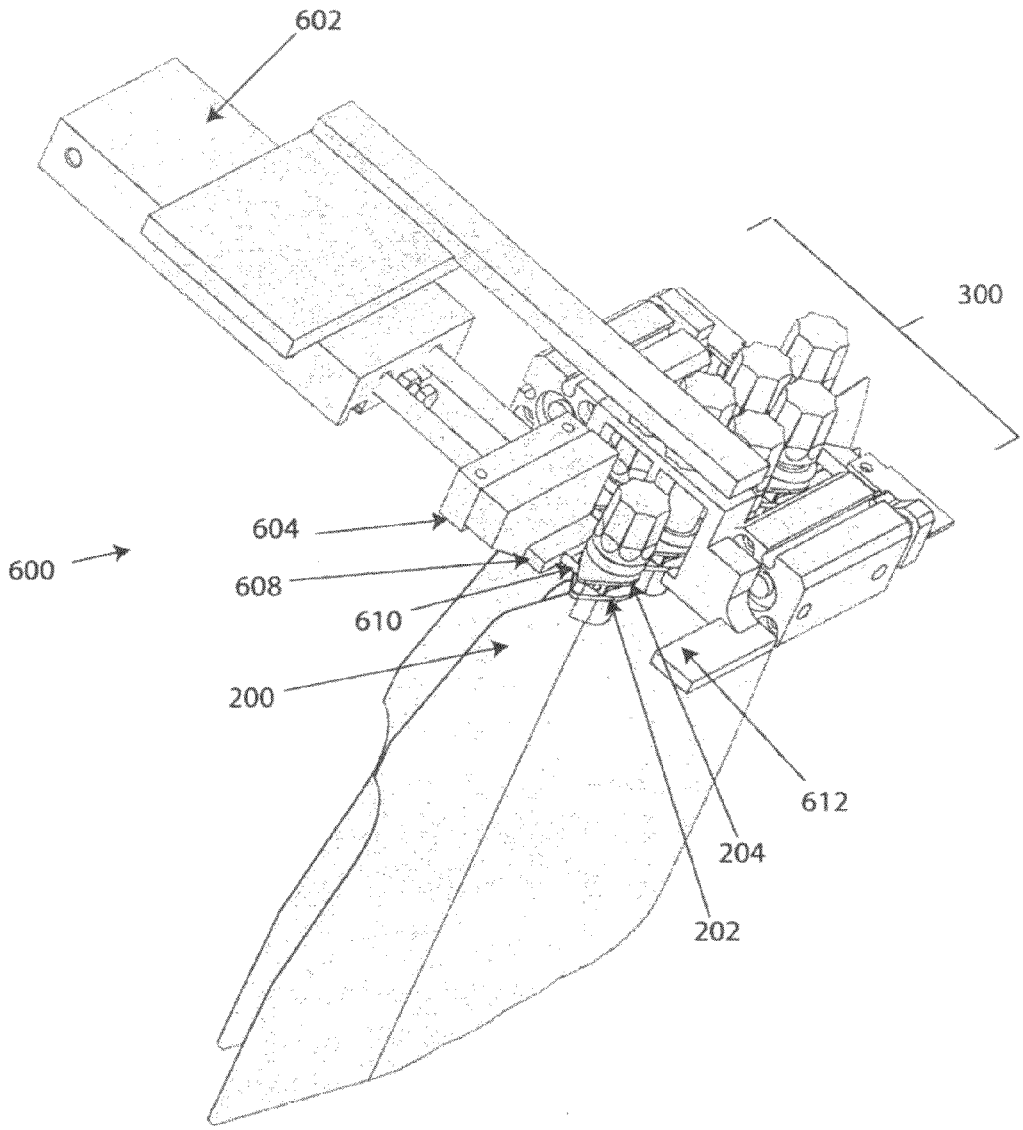
Figure 6D:
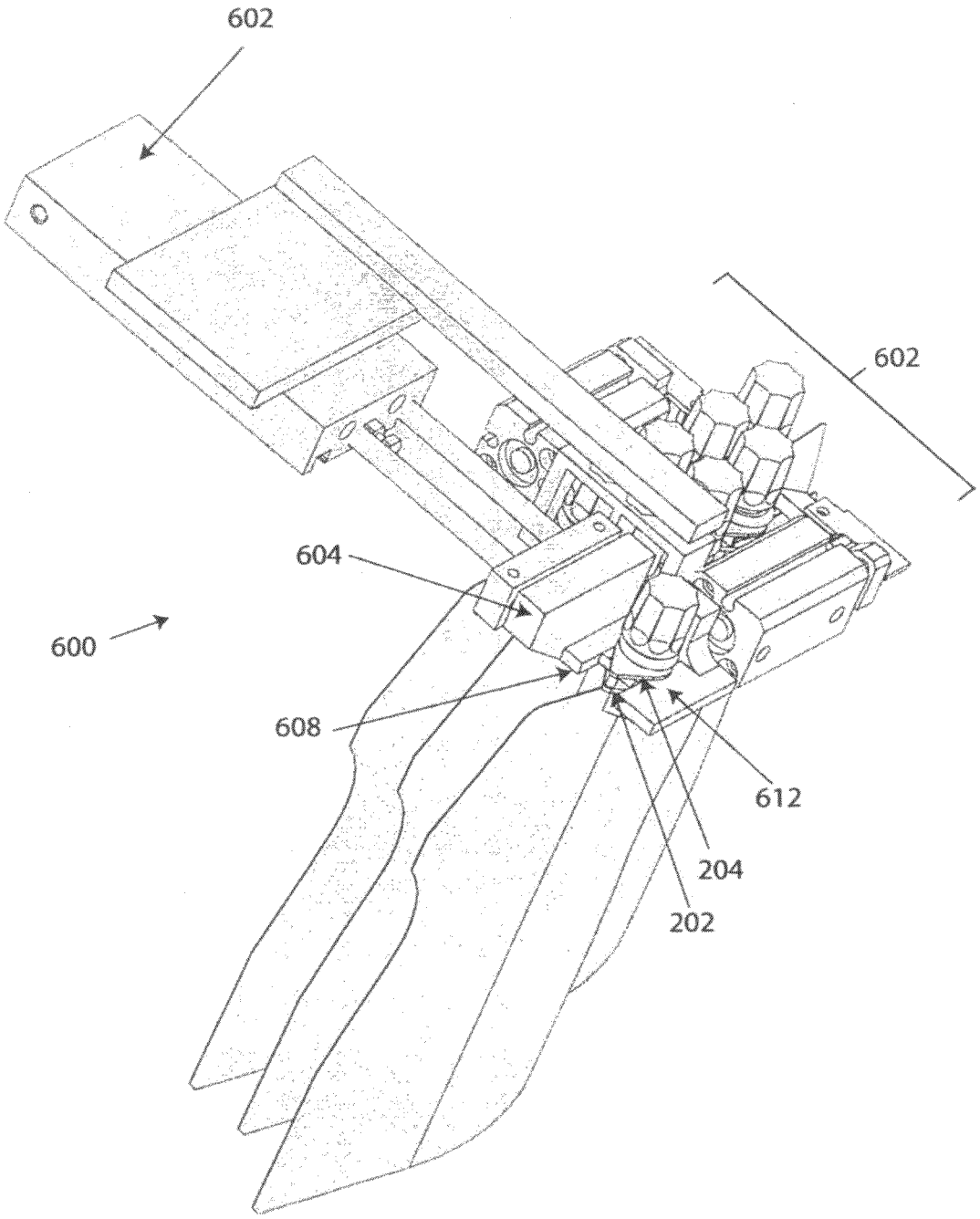

Referring to FIG. 2 and FIGS. 6*a* to 6*d* the feeder mechanism 300 is shown in combination with a selector mechanism 600. The selector mechanism 600 comprises a linear actuator 602 having a selector head 604 movable substantially perpendicular to the direction of movement of the pouches 200 as they are fed through the feeder mechanism 300. The selector head comprises a lip 608 and a retention pin 610 extending therefrom. In use the feeder mechanism 300 operates as described above in relation to FIGS. 2 to 5 to move one chain of interlinked pouches through the feeder mechanism 300 so that the end pouch 200 of the chain protrudes from the feeder mechanism 300 (FIG. 6*b*). The selector mechanism 600 then actuates to move the selector head 604 towards the protruding pouch such that the retention pin 610 passes through an opening in the spout 206 and the lip 608 engages between the two flanges 202, 204 of the pouch (FIG. 6*c*). Continued movement of the selector head 604 separates the pouch 200 with which it is engaged from the chain of pouches and moves it to its filling position (FIG. 6*d*) wherein the flanges 202, 204 on the side of the spout 206 of the pouch 200 facing away from the selector head 604 engage with a fixed retaining lip 612 thereby locating the spout 206 of the pouch 200 in substantially fixed position.

Figure 7:
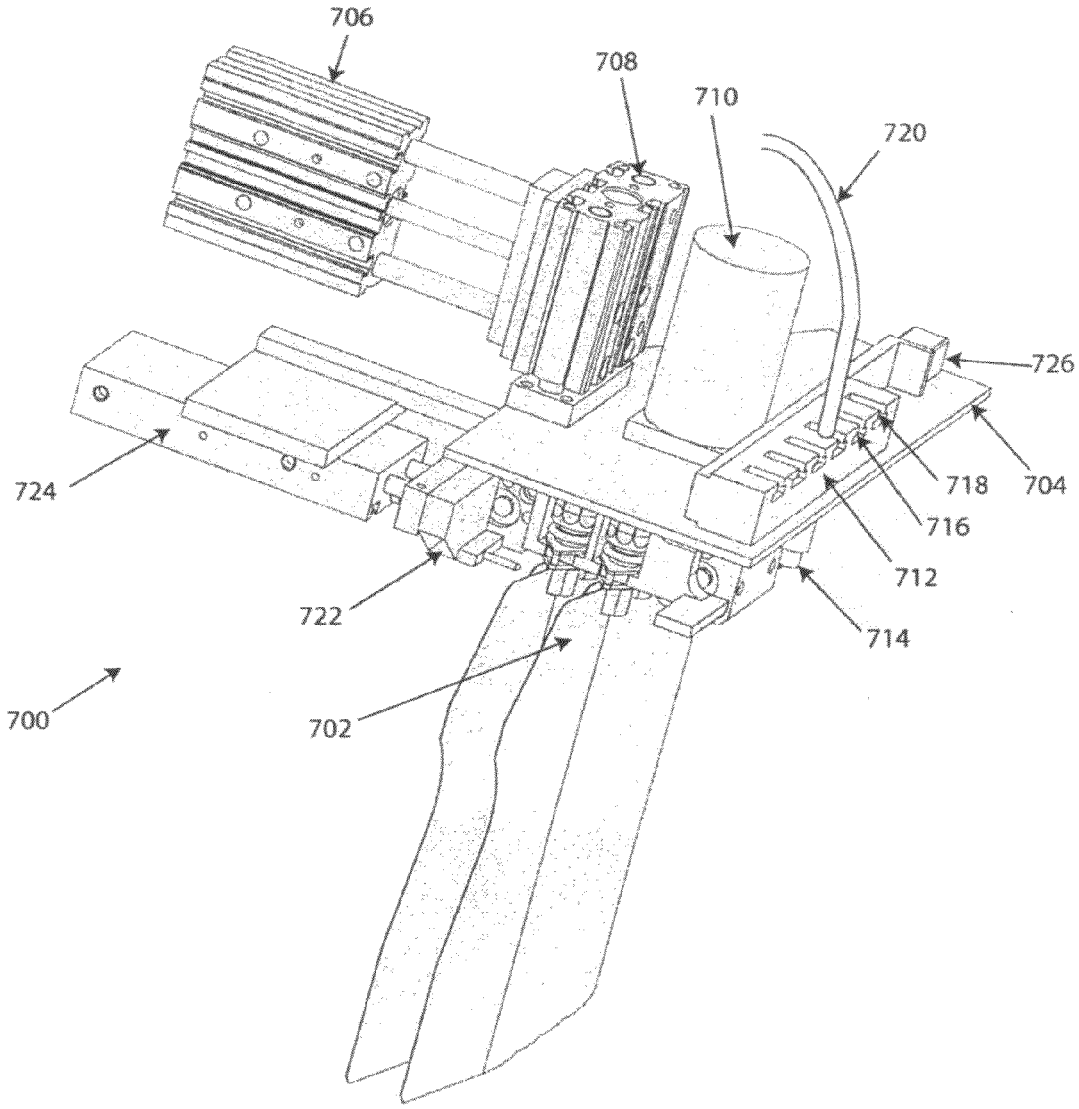
FIGS. 7 and 8 are perspective views of the capping and filling mechanism according to the invention.
Figure 8:
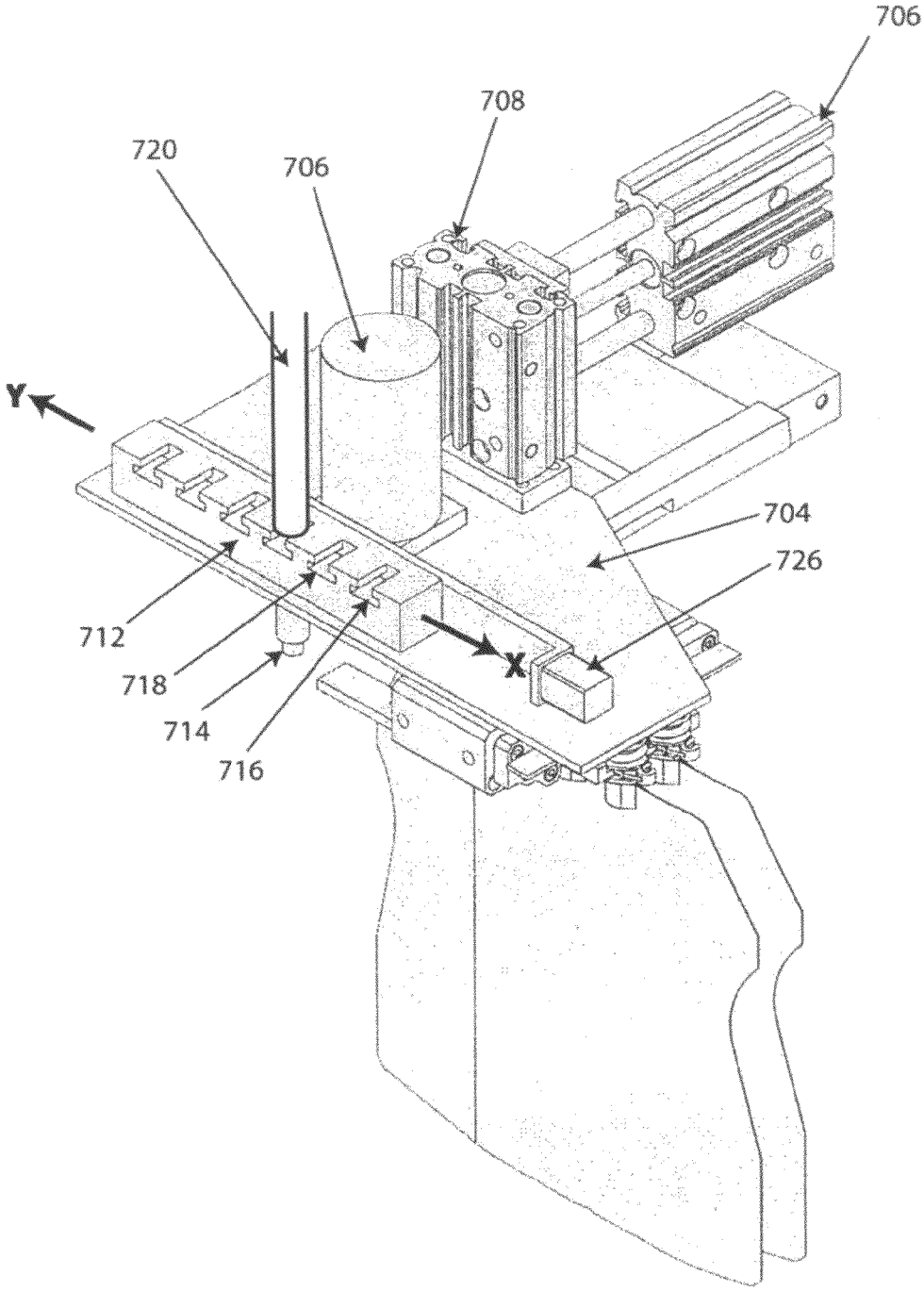

Referring to FIGS. 7 and 8 the mechanism 700 for removing and replacing caps from the flexible pouches 702 and for filling the flexible pouches 702 is shown. The mechanism comprises a platform 704 which is movable in a horizontal axis by means of a first actuator 706 and a vertical axis by means of actuator 708. The actuators 706, 708 are guided linear actuators with their stroke lengths matched to the required motion of the platform in the two directions. Motion in the horizontal direction presents either the capping mechanism 710, or the filling head above the filling position (See FIG. 6*d*). The capping mechanism 710 comprises a rotary actuator and a cap retainer (not shown). Motion in the vertical direction brings either the capping mechanism or the filling nozzle 714 into position respective the flexible pouch. In use, once a pouch has been brought into the filling position (see FIGS. 6*a-d*) the platform 704 is moved to position the capping mechanism 710 above the filling position by means of horizontal actuator 706 and then the platform is moved in the vertical direction by vertical actuator 708 to bring the cap retainer (not shown) into contact with the cap of a pouch 702. The capping mechanism 710 is then activated to unscrew the cap by means of rotary motion and the platform 704 is then raised in the vertical direction to move the cap clear of the pouch 702. The horizontal actuator 706 is then actuated to move the platform 704 in the horizontal direction to position the filling head 712 above the now open top of the pouch 702. The filling head 712 comprises an array of nozzle positions 716, 718, each capable of receiving a nozzle 714 (only one shown for clarity), each nozzle connected to a source of liquid by a flexible conduit 720. The filling head 712 can be indexed in the directions X, Y indicated in FIG. 8 so as to present a nozzle 714 at any position in the array over the opening of the pouch 702. In this manner different liquids can be selectively filled into subsequent pouches by selection of which nozzle the pouch is to be filled from. The filling head 712 is moved by means of actuator 726. When the desired nozzle is positioned above the open top of the pouch 702 in its filing position the platform 704 is moved in the vertical direction to present the nozzle 714 to the opening in the pouch after which liquid can be introduce into the pouch 702 via the conduit 720 and the nozzle 714 to fill it. Once filled the vertical 708 and horizontal 706 actuators are activated in progression to remove the nozzle 714 from the pouch 702 and to reposition the cap above the pouch. The vertical actuator 708 is then actuated to position the cap back on the pouch and the capping mechanism 710 is actuated to screw the cap on. Once the cap is securely fastened, the selector head 722 is withdrawn by linear actuator 724 so as to disengage from the spout of the pouch 702 (see FIGS. 6*a-d* for detail). Once the selector head 722 is disengaged the platform 704 is once again raised in the vertical direction, releasing the cap of the pouch 702 from the capping mechanism 710 and allowing the filled and sealed pouch to drop from the mechanism for dispense.

Figure 9:
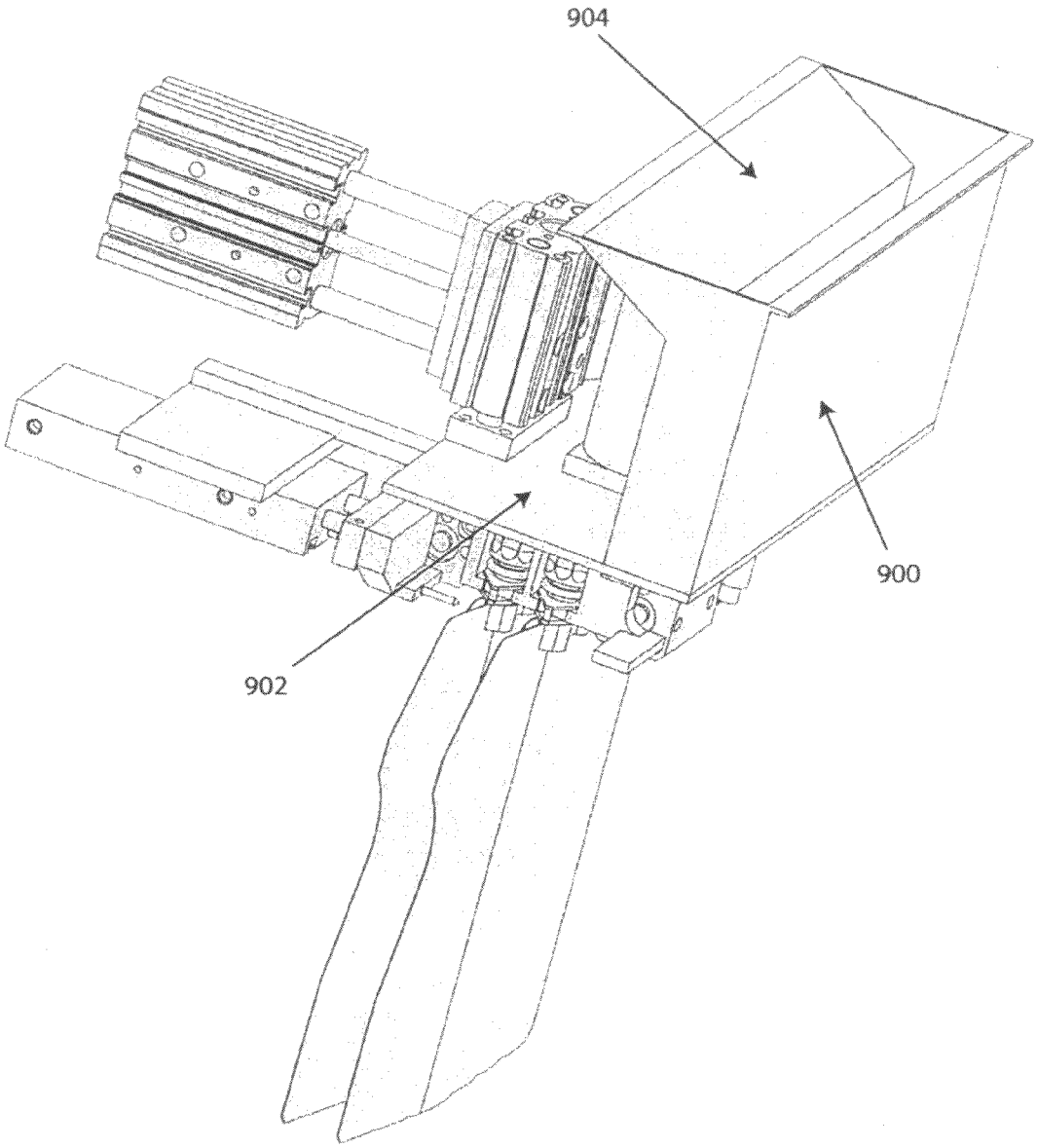
FIG. 9 is a perspective view of a capping and filling mechanism according to the invention having a refrigeration cowling.

Referring to FIG. 9, the mechanism of FIGS. 7 and 8 is shown with a refrigeration cowling 900 attached to the platform 902. In use the refrigeration cowling 900 surrounds the flexible conduits 720 and filling head 712 (FIG. 7) so that in use cooled air may be circulated about these parts via the opening 904 to maintain the liquid therein in a refrigerated condition. The refrigeration cowling 900 may be connected to the source of cooled air by a flexible conduit or may alternatively disengage temporarily while the platform 902 is in its lower position for filling and capping actions.

Alternative arrangements of the invention, for example push fit caps as opposed to screw fit, or having a separate cap removal position and filling position will be apparent to those skilled in the art and are intended to be covered by the scope of the invention.

The invention claimed is:

1. A pouch handling apparatus for separating a flexible pouch from a chain of flexible pouches, and filling the flexible pouch, the apparatus comprising:

a presentation means for presenting at least one chain of flexible pouches into a feeder mechanism through which said chain of pouches passes, said flexible pouches being interlinked via their spouts, the feeder mechanism including a ratchet arm movable in a first direction wherein the ratchet arm will pivot away from the pouches passing by the chain of interlinked pouches without engaging them, and movable in a second opposite direction in which the ratchet arm engages with the chain of interlinked pouches and moves them into the feeder mechanism, a means operable to engage with a spout of an end pouch of said interlinked chain, and to convey said end pouch from the feeder mechanism towards a filling position, a means to pull, via the interlinked spouts, a remainder of the pouches towards the feeder mechanism;

a means of separating a flexible pouch from an end of the chain of interlinked pouches;

a means of filling a flexible pouch via the spout thereof in the filling position;

a means of closing the spout; and a means of releasing the pouch from the pouch handling apparatus.

2. The pouch handling apparatus according to claim 1, wherein the means operable to engage with the spout comprises the feeder mechanism.

3. A pouch handling apparatus according to claim 1, wherein the pouch is filled at the filling position prior to being detached from the chain.

4. A pouch handling apparatus according to claim 1, wherein the pouch is detached from the chain prior to being filled at the filling position.

5. A pouch handling apparatus according to claim 4, wherein said means operable to engage with the spout and said means of separating a flexible pouch from the end of the chain comprises one and the same means.

6. A pouch handling mechanism according to claim 5, wherein said one and the same means comprises a linearly movable selector means arranged for movement substantially perpendicular to the direction of movement of the chain of interlinked pouches and wherein the perpendicular movement of the selector means detaches the selected pouch from the chain.

7. A pouch handling mechanism according to claim 5, wherein the means comprises a ridge, for location in a groove of the spout, and a pin, extendable through a cavity in the spout.

8. A pouch handling apparatus according to claim 1, wherein the spouts of the chain of pouches are provided with caps to maintain them internally clean, and the apparatus further comprises a means for removing the cap prior to filling.

9. A pouch handling apparatus according to claim 8, wherein the cap is removed at the filling position.

10. A pouch handling apparatus according to claim 8, wherein the cap is removed at a cap removal point remote from the filling position.

11. A pouch handling apparatus according to claim 8, wherein the means of closing the spout comprises the step of replacing the cap after the pouch has been filled.

12. A pouch handling apparatus according to claim 1, wherein the ratchet arm is arranged for linear movement.

13. A pouch handling apparatus according to claim 1, wherein the ratchet aim is arranged for rotary movement.

14. A pouch handling apparatus according to claim 1, further comprising a sprung retainer arm in a fixed position whereby when the pouches are moved into the feeder mechanism the retainer arm pivots to allow the chain of spouts to pass and whereby movement of the pouches in the opposite direction is prevented by engagement of the retainer arm with the chain of spouts.

15. A pouch handling mechanism according to claim 1, comprising: a plurality of presentation means, each presentation means having an associated feeder mechanism; means of filling a flexible pouch; means of closing the spout; means of separating a flexible pouch from the end of the chain of interlinked pouches; and a means of releasing the pouch from the pouch handling apparatus.

16. A pouch handling mechanism according to claim 1, further comprising a combined capping and filling mechanism for removing a cap from a pouch, filling the pouch with liquid and re-attaching a cap to the pouch to close the spout, said mechanism being movable in a horizontal and a vertical direction to present either a capper or a filling nozzle to the spout of a flexible pouch.

17. A pouch handling mechanism according to claim 16, wherein the combined capping and filling mechanism further comprises a filling head arranged to receive and retain an array of nozzles from a plurality of liquid supplies and the filling head is indexable to present a selected one of said nozzles to the spout to fill the pouch therethrough.

18. A pouch handling mechanism according to claim 17, further comprising a refrigeration cowling surrounding the filling head to enable refrigerated air to circulate around said filling head to maintain it in a refrigerated condition.

* * * * *